US007371290B2

(12) United States Patent
Mino et al.

(10) Patent No.: US 7,371,290 B2
(45) Date of Patent: May 13, 2008

(54) PRODUCTION METHOD FOR PERMANENT MAGNET AND PRESS DEVICE

(75) Inventors: Shuji Mino, Suita (JP); Noboru Nakamoto, Yawata (JP); Tsutomu Harada, Settsu (JP)

(73) Assignee: Neomax Co., Ltd., Osaka (JP)

( * ) Notice: Subject to any disclaimer, the term of this patent is extended or adjusted under 35 U.S.C. 154(b) by 456 days.

(21) Appl. No.: 10/474,546

(22) PCT Filed: Dec. 2, 2002

(86) PCT No.: PCT/JP02/12611

§ 371 (c)(1),
(2), (4) Date: Oct. 9, 2003

(87) PCT Pub. No.: WO03/056583

PCT Pub. Date: Jul. 10, 2003

(65) Prior Publication Data

US 2004/0112467 A1 Jun. 17, 2004

(30) Foreign Application Priority Data

Dec. 26, 2001 (JP) ..... 2001-393880

(51) Int. Cl.
*H01F 1/08* (2006.01)

(52) U.S. Cl. ..... 148/103; 148/101; 148/104

(58) Field of Classification Search ..... None
See application file for complete search history.

(56) References Cited

U.S. PATENT DOCUMENTS 4,888,512 A 12/1989 Shimizu
4,981,532 A 1/1991 Takeshita et al.
6,432,158 B1 8/2002 Harada et al.
6,432,354 B2 8/2002 Ogawa et al.
2001/0018029 A1* 8/2001 Ogawa et al. ..... 419/66
2004/0241034 A1* 12/2004 Mino et al. ..... 419/66

FOREIGN PATENT DOCUMENTS

EP 1 447 827 A1 8/2004
JP 2001-093712 4/2001
JP 2001-192705 A 7/2001
JP 2001-226701 A 8/2001

OTHER PUBLICATIONS

Machine English Language Translation of Japanse Patent Document No. JP2001-226701A.*
Supplementary European Search Report Dated Feb. 18, 2005 for EP 02 78 6003.

* cited by examiner

*Primary Examiner*—John P. Sheehan
(74) *Attorney, Agent, or Firm*—Nixon Peabody LLP; Jeffrey L. Costellia

(57) ABSTRACT

To avoid various problems caused by remnant magnetization and produce an anisotropic bonded magnet at a reduced cost, a method for producing an anisotropic bonded magnet by feeding a magnetic powder (such as an HDDR powder) into the cavity of a press machine and compacting it is provided. A weak magnetic field is created as a static magnetic field in a space including the cavity by using a magnetic member that is steadily magnetized. The magnetic powder being transported into the cavity is aligned parallel to the direction of the weak magnetic field. Next, the magnetic powder is compressed in the cavity, thereby obtaining a compact.

11 Claims, 7 Drawing Sheets

PRODUCTION METHOD FOR PERMANENT MAGNET AND PRESS DEVICE

TECHNICAL FIELD

The present invention relates to a method for producing a permanent magnet and also relates to a press machine.

BACKGROUND ART

An R—Fe—B based rare-earth magnet (where R is one of the rare-earth elements including Y, Fe is iron, and B is boron) is a typical high-performance permanent magnet, has a structure including, as a main phase, an $R_2Fe_{14}B$ phase, which is a tertiary tetragonal compound, and exhibits excellent magnet performance.

Such R—Fe—B based rare-earth magnets are roughly classifiable into sintered magnets and bonded magnets. A sintered magnet is produced by compacting a fine powder of an R—Fe—B based magnet alloy (with a mean particle size of several μm) with a press machine and then sintering the resultant compact. On the other hand, a bonded magnet is produced by compacting a mixture (i.e., a compound) of a powder of an R—Fe—B based magnet alloy (with particle sizes of about 100 μm) and a binder resin within a press machine.

The sintered magnet is made of a powder with relatively small particle sizes, and therefore, the respective powder particles thereof exhibit magnetic anisotropy. For that reason, an aligning magnetic field is applied to the powder being compacted by the press machine, thereby obtaining a compact in which the powder particles are aligned with the direction of the magnetic field.

In the bonded magnet on the other hand, the powder particles used have particle sizes exceeding the single domain critical size, and normally exhibit no magnetic anisotropy and cannot be aligned under a magnetic field applied. Accordingly, to produce an anisotropic bonded magnet in which the powder particles are aligned with particular directions, a technique of making a magnetic powder, of which the respective powder particles exhibit the magnetic anisotropy, needs to be established.

To make a rare-earth alloy powder for an anisotropic bonded magnet, an HDDR (hydrogenation-disproportionation-desorption-recombination) process is currently carried out. The "HDDR" process means a process in which the hydrogenation, disproportionation, desorption and recombination are carried out in this order. In this HDDR process, an ingot or a powder of an R—Fe—B based alloy is maintained at a temperature of 500° C. to 1,000° C. within an $H_2$ gas atmosphere or a mixture of an $H_2$ gas and an inert gas so as to occlude hydrogen. Thereafter, the hydrogenated ingot or powder is subjected to a desorption process at a temperature of 500° C. to 1,000° C. until a vacuum atmosphere with an $H_2$ partial pressure of 13 Pa or less or an inert atmosphere with an $H_2$ partial pressure of 13 Pa or less is created. Then, the desorbed ingot or powder is cooled, thereby obtaining an alloy magnet powder.

An R—Fe—B based alloy powder, produced by such an HDDR process, exhibits huge coercivity and has magnetic anisotropy. The alloy powder has such properties because the metal structure thereof substantially becomes an aggregation of crystals with very small sizes of 0.1 μm to 1 μm. More specifically, the high coercivity is achieved because the grain sizes of the very small crystals, obtained by the HDDR process, are close to the single domain critical size of a tetragonal $R_2Fe_{14}B$ based compound. The aggregation of those very small crystals of the tetragonal $R_2Fe_{14}B$ based compound will be referred to herein as a "recrystallized texture". Methods of making an R-Fe-B based alloy powder having the recrystallized texture by the HDDR process are disclosed in Japanese Patent Gazettes for Opposition Nos. 6-82575 and 7-68561, for example.

However, if an anisotropic bonded magnet is produced with a magnetic powder prepared by the HDDR process (which will be referred to herein as an "HDDR powder"), then the following problems will arise.

A compact, obtained by pressing a mixture (i.e., a compound) of the HDDR powder and a binder resin under an aligning magnetic field, has been strongly magnetized by the aligning magnetic field. If the compact remains magnetized, however, a magnet powder may be attracted toward the surface of the compact or the compacts may attract and contact with each other to be chipped, for example. In that case, it will be very troublesome to handle such compacts in subsequent manufacturing process steps. For that reason, before unloaded from the press machine, the compact needs to be demagnetized sufficiently. Accordingly, before the magnetized compact is unloaded from the press machine, a "degaussing process" of applying a degaussing field such as a demagnetizing field, of which the direction is opposite to that of the aligning magnetic field, or an alternating attenuating field to the compact needs to be carried out. However, such a degaussing process normally takes as long a time as several tens of seconds. Accordingly, in that case, the cycle time of the pressing process will be twice or more as long as a situation where no degaussing process is carried out (i.e., the cycle time of an isotropic bonded magnet). When the cycle time is extended in this manner, the mass productivity will decrease and the manufacturing cost of the magnet will increase unintentionally.

As for a sintered magnet on the other hand, even if the compact thereof is not degaussed sufficiently, the compact remains magnetized just slightly, because its material magnet powder has low coercivity from the beginning. Also, in the sintering process step, the magnet powder is exposed to an elevated temperature that is higher than the Curie temperature thereof. Thus, the magnet powder will be completely degaussed before subjected to a magnetizing process step. In contrast, as for an anisotropic bonded magnet, if the compact thereof remains magnetized when unloaded from the press machine, then the magnetization will remain there until the magnetizing process step. And if the bonded magnet remains magnetized in the magnetizing process step, the magnet is very hard to magnetize due to the hysteresis characteristic of the magnet.

In order to overcome the problems described above, a main object of the present invention is to provide a method and a press machine for producing an easily magnetizable permanent magnet (e.g., an anisotropic bonded magnet among other things) at a reduced cost by avoiding the problems caused by the unwanted remanent magnetization of the compact.

DISCLOSURE OF INVENTION

A permanent magnet producing method according to the present invention is a method for producing a permanent magnet by feeding a magnetic powder into a cavity of a press machine and compacting the magnetic powder. The method includes the steps of: creating a weak magnetic field as a static magnetic field in a space including the cavity and transporting the magnetic powder toward the inside of the cavity while aligning the magnetic powder parallel to the direction of the weak magnetic field; and compacting the magnetic powder inside of the cavity, thereby obtained a compact.

In a preferred embodiment, the weak magnetic field is created by using a magnetic member that is magnetized steadily.

In another preferred embodiment, the weak magnetic field is also applied in the step of compacting the magnetic powder inside of the cavity.

In another preferred embodiment, the weak magnetic field is adjusted such that the compact, which has just been pressed by the press machine, has a surface flux density of 0.005 tesla or less.

In another preferred embodiment, the strength of the weak magnetic field is adjusted to the range of 8 kA/m to 120 kA/m inside of the cavity.

The strength of the weak magnetic field is preferably adjusted so as to have an upper limit of 100 kA/m or less, more preferably 80 kA/m or less.

In another preferred embodiment, after the magnetic powder has been compacted inside of the cavity, the compact is unloaded from the cavity without being subjected to any degaussing process.

In another preferred embodiment, the magnetic member is one of members that make up a die of the press machine.

In another preferred embodiment, at least a portion of the magnetic member is a permanent magnet.

In another preferred embodiment, at least a portion of the magnetic powder is an HDDR powder.

In another preferred embodiment, the press machine includes: a die having a through hole; a core, which reciprocates inside of, and with respect to, the through hole; and a lower punch, which reciprocates between the inner surface of the through hole and the outer surface of the core and with respect to the die. The step of transporting the magnetic powder toward the inside of the cavity includes the steps of: positioning a feeder box, including the magnetic powder, over the through hole of the die after the through hole has been closed up with the lower punch; moving the core upward with respect to the die; and moving the die upward with respect to the core, thereby defining the cavity under the feeder box.

A press machine according to the present invention includes: a die having a through hole; an upper punch and a lower punch, which are able to reciprocate inside of the through hole and with respect to the die; and a powder feeder for feeding a magnetic powder into a cavity that is defined inside of the through hole of the die. The press machine further includes members that have been magnetized for alignment purposes. The members are used to apply a weak magnetic field as a static magnetic field to the magnetic powder being transported into the cavity.

In a preferred embodiment, at least one of the members that have been magnetized for alignment purposes is a permanent magnet.

A permanent magnet according to the present invention is produced by a compaction process. The magnet is obtained by aligning and compacting a magnetic powder inside of a press machine under a weak magnetic field as a static magnetic field. The remanent magnetization of the magnet is represented by a surface flux density of 0.005 tesla or less when unloaded from the press machine without being subjected to any degaussing process.

BEST MODE FOR CARRYING OUT THE INVENTION

Figure 1A:
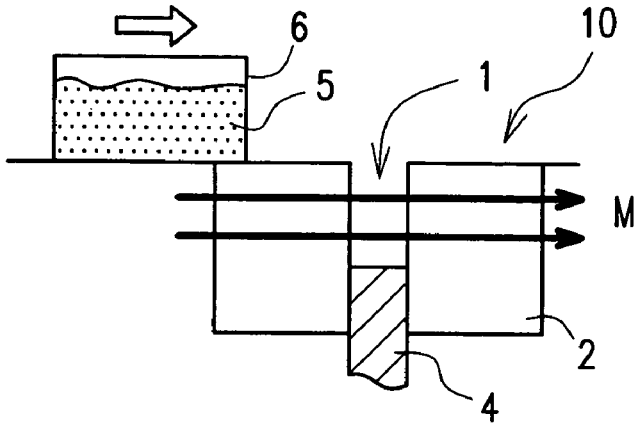
FIGS. 1(*a*) through 1(*d*) are cross-sectional views showing how the main members of a press machine according to a preferred embodiment of the present invention operate in respective manufacturing process steps.
Figure 1B:
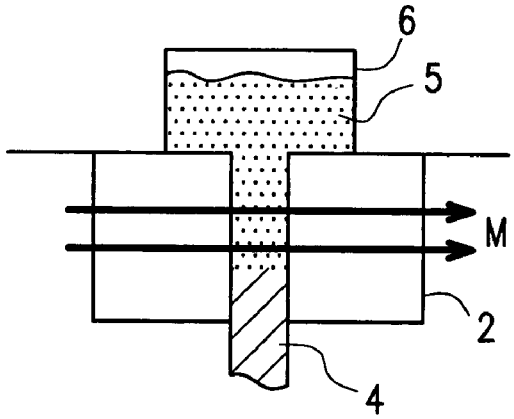
Figure 1C:
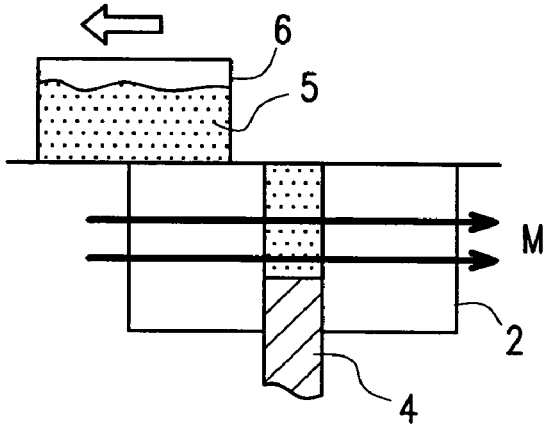
Figure 1D:
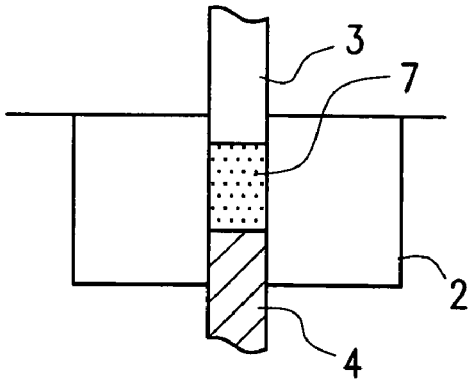

The present inventors discovered that if a weak magnetic field is applied as a static magnetic field to a magnetic powder being fed into the cavity of a press machine, a permanent magnet having a sufficiently high degree of alignment can be obtained without applying any strong aligning magnetic field thereto as in the conventional process. The present inventors obtained the basic idea of the present invention in this manner.

According to the present invention, the strength of the magnetic field to be applied for alignment purposes is so weak that the remanent magnetization of the as-pressed compact can be reduced sufficiently. Thus, there is no need to perform any additional degaussing process thereon.

It should be noted that a technique of aligning a magnetic powder effectively by applying an aligning magnetic field to the magnetic powder being transported (i.e., dropped) into a cavity is already described in Japanese Laid-Open Publications Nos. 2001-93712 and 2001-226701. In the present invention, however, a permanent magnet compaction process is carried out with a significantly smaller magnetic field than that disclosed in any of these publications, thereby reducing the surface flux density, resulting from the remanent magnetization of the compact, to 0.005 tesla or less without performing any degaussing process step. According to the present invention, no aligning magnetic field generator of a big size is needed anymore unlike the conventional process and the cycle time of the pressing process can be shortened significantly.

Embodiment 1

Hereinafter, a first specific preferred embodiment of the present invention will be described with reference to the accompanying drawings. In this preferred embodiment, an anisotropic bonded magnet is produced.

FIGS. 1(*a*) through 1(*d*) show main process steps (i.e., from the process step of feeding a powder under an aligning magnetic field to the process step of compacting the powder) of a magnet producing method according to the present invention. The press machine 10 shown in FIG. 1 includes a die 2 having a through hole 1, an upper punch 3 and a lower punch 4, which are able to reciprocate inside of, and with respect to, the through hole 1, and a powder feeder (e.g., feeder box) 6 for feeding a magnetic powder (i.e., a compound) 5 into a cavity that is defined inside of the through hole 1 of the die 2.

In this preferred embodiment, at least a portion of the magnetic member (made of a ferromagnetic material) used as the die 2 has been magnetized. Thus, a weak magnetic field can be applied as a static magnetic field to the magnetic powder 5 being transported into the cavity. The degree of magnetization is defined such that the strength of the weak magnetic field, created inside of the cavity, falls within the range of about 8 kA/m to about 120 kA/m (as measured at the center of the cavity). The magnetic member magnetized steadily forms a weak magnetic field as a static magnetic field (as identified by the reference sign "M" in FIG. 1) inside of the cavity, thereby appropriately aligning the compound being fed.

The magnetic member for use to create the weak magnetic field as a static magnetic field is preferably provided near the cavity. However, its specific arrangement and configuration may be appropriately designed according to the desired magnetic field distribution. A die, provided for a normal press machine, includes a member (or a portion) that is made of a ferromagnetic material. Accordingly, if that member (or portion) is magnetized under a strong magnetic field, magnetization at a required level is achieved. The magnetic member may be magnetized either before the die is set in the press machine or after the die has already been set in the press machine. A conventional press machine for an anisotropic bonded magnet includes a coil for generating a strong aligning magnetic field to be applied after the powder has been fed. Thus, a portion of the die may also be magnetized with the strong magnetic field being created by this coil.

Figure 2A:
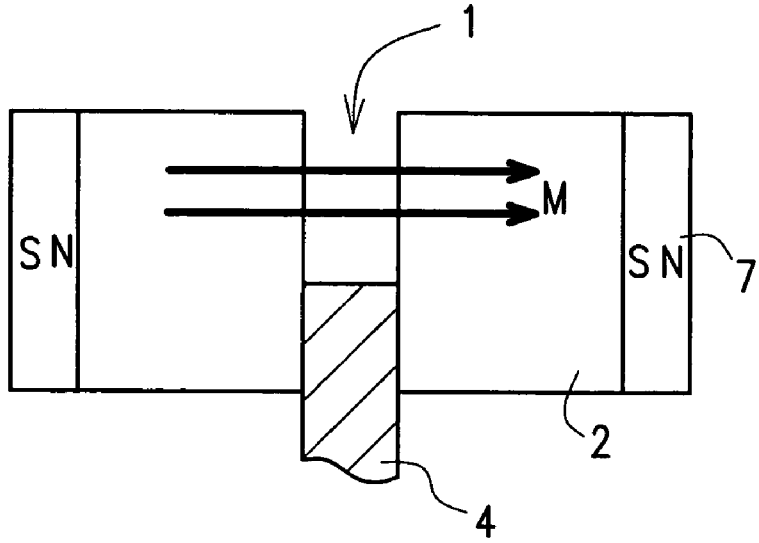
FIG. 2 shows an arrangement in which a permanent magnet is used as a magnetic member for creating a weak aligning magnetic field.
Figure 2B:
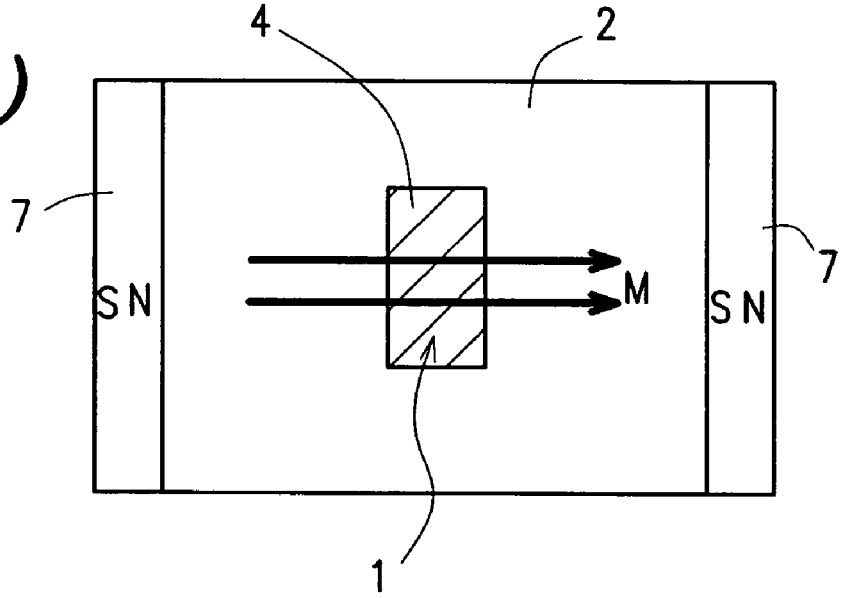
Figure 3A:
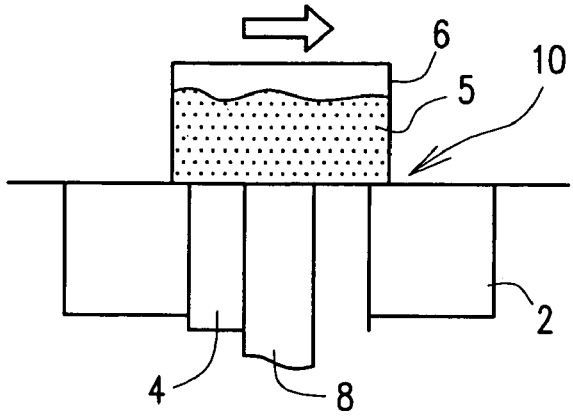
FIGS. 3(*a*) through 3(*d*) are cross-sectional views showing how the main members of a press machine according to a second specific preferred embodiment of the present invention operate in respective manufacturing process steps.
Figure 3B:
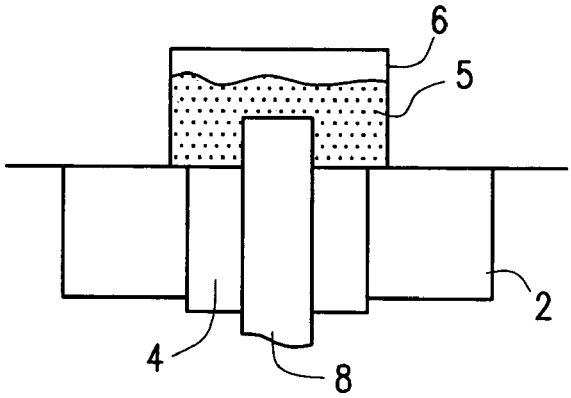
Figure 3C:
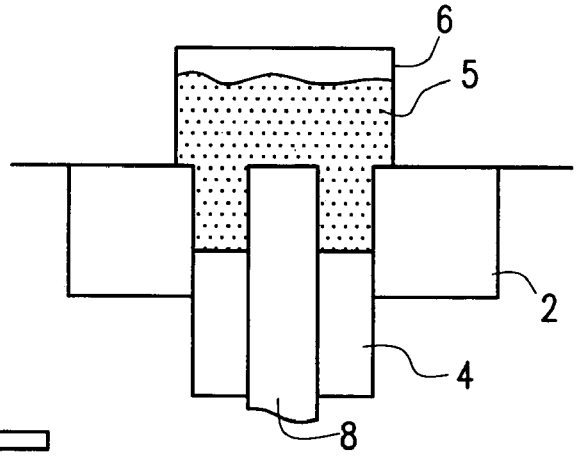
Figure 3D:
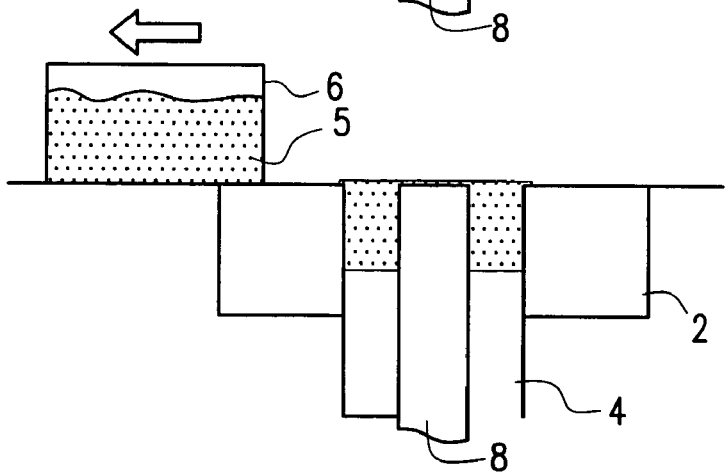

It should be noted that instead of magnetizing a portion of the die 2, a permanent magnet may be embedded in the die 2 or provided around the die 2. FIGS. 2(*a*) and 2(*b*) show an example in which a pair of permanent magnets (e.g., rare-earth sintered magnets) 7 are arranged on right- and left-hand sides of the die 2. In this example, an aligning magnetic field is created in the cavity space by the two permanent magnets 7. In creating an aligning magnetic field by arranging the permanent magnets 7, if the arrangement is modified by appropriately changing the number or the degree of magnetization of the permanent magnets used, then a novel aligning magnetic field distribution, which has been unachievable by any conventional method, can also be formed.

Hereinafter, a method for producing an anisotropic bonded magnet with the machine shown in FIG. 1 will be described.

First, a mixture (i.e., a compound) 5 of the HDDR powder described above and a binder (i.e., a binder resin) is prepared. The feeder box 6 is filled with this compound 5 and then transported to a position just over the cavity of the die 2 of the press machine as shown in FIGS. 1(*a*) and 1(*b*). Then, the compound 5 drops into the cavity and fills the cavity. While the cavity is being filled with the powder in this manner, the powder particles, included in the compound 5, are effectively aligned under a weak magnetic field as a static magnetic field. This is believed to be because the respective powder particles being transported into the cavity can rotate relatively easily while dropping into the cavity.

The present inventors discovered via experiments that the compound 5 being loaded into the cavity should be dropped into the cavity little by little in a relatively long time rather than in quantity at a time. The reason is believed to be as follows. Specifically, if the compound 5 is fed as relatively large chunks, then the free motion (e.g., rotation among other things) of the respective powder particles will be interfered with and the degree of alignment will decrease. In contrast, if the compound 5 is fed little by little, then the respective powder particles can rotate relatively freely and can be aligned smoothly even under a weak magnetic field.

If a strong static magnetic field was applied from a conventional coil for applying an aligning magnetic field to the compound 5 being loaded into the cavity, then the powder particles would be cross-linked together in the direction of the aligning magnetic field between the inner walls of the cavity, thus clogging the cavity up partially. In that case, the cavity could not be filled with the powder uniformly. In contrast, if a relatively weak magnetic field is applied to the compound 5 as is done in this preferred embodiment, then the powder particles are hardly cross-linked together magnetically.

Next, after the feeder box 6 has been brought back from over the cavity to a retreated position as shown in FIG. 1(*c*), the upper punch 3 is lowered as shown in FIG. 1(*d*), thereby compressing the compound 5 in the cavity and obtaining a compact 7.

In this preferred embodiment, the powder being fed is aligned under a magnetic field. Thus, even a relatively weak magnetic field of about 8 kA/m to about 120 kA/m can achieve a sufficiently high degree of alignment. Conversely, if the magnetic field applied is too strong (e.g., more than 800 kA/m as in the conventional aligning magnetic field), then the powder particles would be cross-linked together magnetically, thus interfering with smooth powder feeding unintentionally.

According to this preferred embodiment, the magnetization of the as-pressed compact 7 (i.e., the remnant magnetization) can be reduced by at least one order of magnitude as compared with the conventional one. Thus, various operations that have been required in the conventional process step of aligning the loaded powder under a strong magnetic field (e.g., creating a very small space over the powder in the cavity to get the powder aligned more easily, aligning the powder in such a state, and immediately pressing and compressing the powder to obtain a compact) are not needed anymore. In addition, the compact 7 does not have to be subjected to any degaussing process, either. As a result, according to this preferred embodiment, the cycle time of the pressing process can be shortened to half or less of that of the conventional anisotropic bonded magnet (i.e., approximately equal to that of an isotropic magnet).

Furthermore, according to this preferred embodiment, the aligning magnetic field is created by the weakly magnetized magnetic member. Thus, the aligning magnetic field is continuously applied not just during powder feeding but also compressing the compound 5 between the upper and lower punches 3 and 4. As a result, the disturbed orientations, which are likely to occur during the compaction process, can be minimized.

Embodiment 2

Hereinafter, a second specific preferred embodiment of the present invention will be described with reference to FIGS. 3 through 7. In this preferred embodiment, a radially aligned ring-shaped anisotropic bonded magnet is produced. Specifically, a substantially radially aligned, thin-ring-shaped anisotropic bonded magnet 11 such as that shown in FIG. 5 can be obtained by using the die 2 shown in FIGS. 4(*a*) and 4(*b*).

Figure 4A:
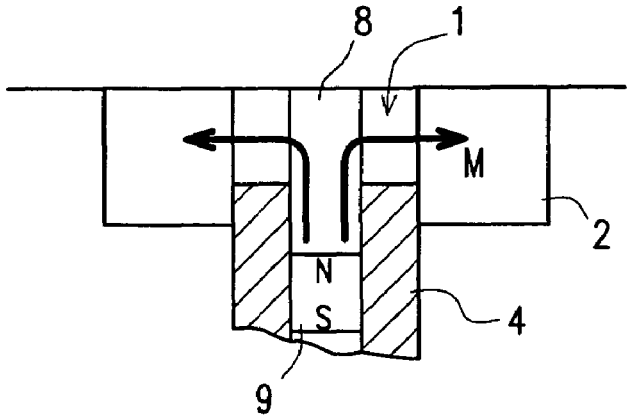
FIG. 4 illustrates a configuration for the press machine for use in the second preferred embodiment of the present invention.
Figure 4B:
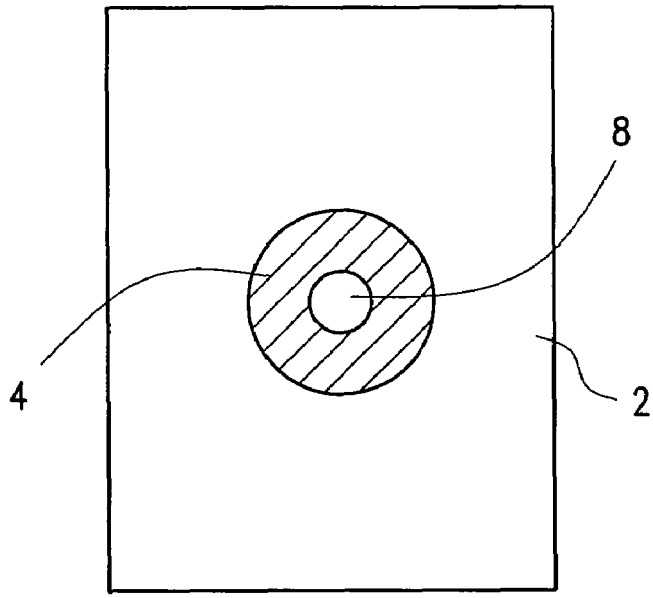
Figure 5:
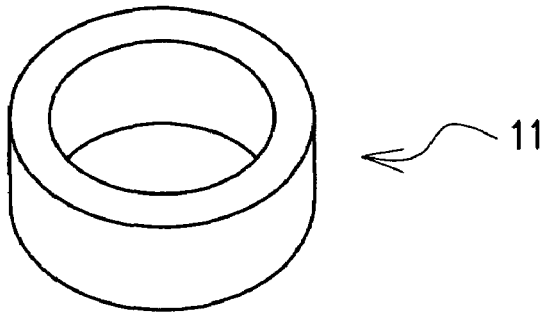
FIG. 5 illustrates a thin-ring-shaped anisotropic bonded magnet obtained by the present invention.

The die 2 for use in this preferred embodiment is made of a ferromagnetic material and has a through hole at the center thereof as shown in FIG. 4. A cylindrical core 8, which is also made of a ferromagnetic material, is inserted into the center of the through hole. In this preferred embodiment, a permanent magnet 9, magnetized in the direction in which the core 8 moves, is provided for the lower portion of the core 8. Thus, the core 8 itself is also magnetized. The cavity is defined between the inner wall of the die through hole and the outer surface of the core 8. A radially aligning magnetic field is created inside of the cavity by the core 8 and the die 2.

Hereinafter, it will be described with reference to FIG. 3 how the press machine of this preferred embodiment operates.

First, as in the first preferred embodiment described above, a mixture (i.e., a compound) 5 of the HDDR powder and a binder (i.e., a binder resin) is prepared. The feeder box 6 is filled with this compound 5 and then transported to a position just over the die 2 of the press machine 10 as shown in FIG. 3(*a*). More specifically, the feeder box 6 should be located over a portion of the die 2 where the cavity will be defined. In this preferred embodiment, the respective upper surfaces of the die 2, lower punch 4 and core 8 are located at substantially equal levels at this point in time, and therefore, no cavity space has been defined yet.

Next, as shown in FIG. 3(*b*), the core 8 is moved upward with respect to the die 2 and the lower punch 4. Thereafter, as shown in FIG. 3(*c*), the die 2 is moved upward with respect to the core 8 and the lower punch 4, thereby aligning the upper surface level of the die 2 with that of the core 8. As a result of these operations, the cavity is defined and filled with the compound 5.

While the powder is being loaded into the cavity in this manner, the powder particles, included in the compound 5, are radially aligned effectively under a weak magnetic field, which is created as a static magnetic field between the core 8 and the die 2 that have been magnetized by the permanent magnet 9 (see FIG. 4).

According to this preferred embodiment, while the cavity is being filled with the compound 5, no powder particles will be cross-linked together between the inner walls of the cavity and clog the cavity up partially. For that reason, the powder can be loaded more uniformly and more quickly than the first preferred embodiment described above. Thus, the method of this preferred embodiment is effectively applicable for use in a cavity that is normally hard to fill with the powder completely. Among other things, this method is particularly effective in producing a thin-ring-shaped anisotropic bonded magnet.

Next, after the feeder box 6 has been brought back from over the cavity to a retreated position as shown in FIG. 3(*d*), the upper punch (not shown) is lowered, thereby compressing the compound 5 in the cavity and obtaining a compact.

In this preferred embodiment, the powder being fed is aligned under a magnetic field. Thus, even a weak magnetic field can achieve a sufficiently high degree of alignment. As a result, the magnetization of the as-pressed compact (i.e., the remnant magnetization) can be reduced by at least one order of magnitude as compared with the conventional one.

Furthermore, according to this preferred embodiment, the aligning magnetic field is created by the weakly magnetized magnetic member as in the preferred embodiment described above. Thus, the aligning magnetic field is continuously applied not just during powder feeding but also compressing the compound 5 between the upper punch and the lower punch 4.

Figures 6A, 6B, 6C, 6D, 6E:
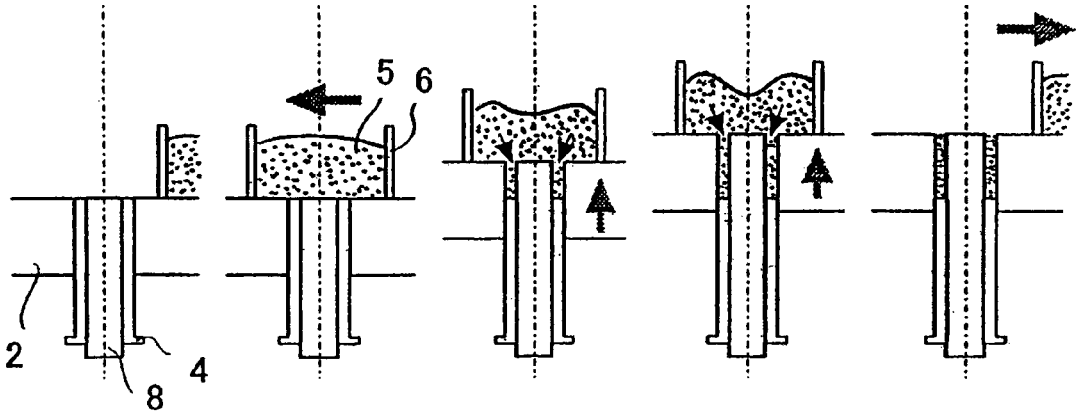
FIGS. 6(*a*) through 6(*e*) are cross-sectional views showing how the main members of a press machine according to another specific preferred embodiment of the present invention operate in respective manufacturing process steps.
Figures 7A, 7B, 7C, 7D, 7E:
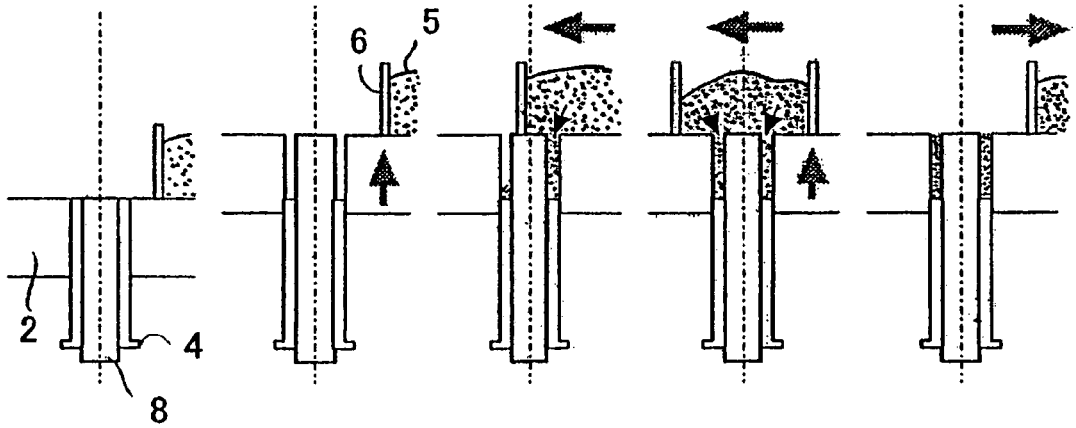
FIGS. 7(*a*) through 7(*e*) are cross-sectional views showing how the main members of a press machine according to yet another specific preferred embodiment of the present invention operate in respective manufacturing process steps.

In the preferred embodiment described above, after the feeder box 6 has been transported to over a region where the cavity will be defined and before the cavity space is defined, the core is inserted into the feeder box. However, the present invention is not limited to such a powder feeding method. Alternatively, the cavity may be defined under the feeder box 6 and filled with the compound 5 at the same time by moving the core 8 and the die 2 upward with respect to the lower punch 4 as shown in FIGS. 6(*a*) through 6(*e*). As another alternative, the feeder box 6 may be transported to over a predefined cavity so as to allow the compound 5 to drop from the feeder box 6 into the cavity as shown in FIGS. 7(*a*) through 7(*e*).

Figure 8:
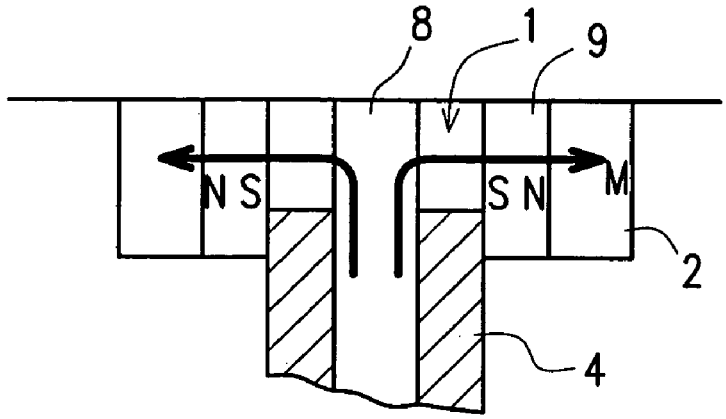
FIG. 8 illustrates a configuration for another press machine for use in the second preferred embodiment of the present invention.

FIG. 8 shows a configuration for another press machine that may be used in this preferred embodiment. In the press machine having the configuration shown in FIG. 8, a radially aligned ring-shaped permanent magnet 9 (that has been magnetized so as to have an S pole inside and an N pole outside in the example shown in FIG. 8) is provided on the inner walls of the through hole of the die 2. A cavity is defined between the inner surface of this permanent magnet 9 and the outer surface of the core 8. When the compound 5 that has been loaded into the cavity is compressed, a strong friction is caused by the compound 5 on the inner surface of the permanent magnet 9. Thus, to prevent the permanent magnet 9 from being damaged, a thin film member is preferably provided between the inner surface of the permanent magnet 9 and the lower punch 4.

The thin film member may be made of either a non-magnetic material or a magnetic material and may be either a metal or a non-metal such as a ceramic.

Even when the arrangement shown in FIG. 8 is adopted, the radial alignment is achieved as effectively as in the arrangement shown in FIG. 4. Optionally, a press machine having both of the arrangements shown in FIGS. 4 and 8 may also be used. In that case, the two types of permanent magnets generate appropriate aligning magnetic field distributions and the radial alignment is achieved even more effectively.

Also, in the arrangement shown in FIG. 8, the radially aligned ring-shaped permanent magnet 9 is provided on the inner walls of the through hole of the die 2. Alternatively, a radially aligned ring-shaped permanent magnet may be provided on the outer surface of the core 8 and a cavity may be defined between the outer surface of this ring-shaped permanent magnet and the inner walls of the through hole of the die 2. As another alternative, these radially aligned ring-shaped permanent magnets may also be provided both on the inner walls of the through hole of the die 2 and on the outer surface of the core 8. Even so, the desired radial alignment is also achievable.

In the preferred embodiment described above, the radially aligned ring-shaped permanent magnet is magnetized such that the inner or outer surface thereof exhibits a single magnetic polarity (i.e., either N pole or S pole). Alternatively, a ring-shaped permanent magnet to be provided on the inner walls of a dice-shaped through hole may have multiple pairs of opposite magnetic poles that are arranged alternately along the inner surface thereof. When such a configuration is adopted, the resultant ring-shaped permanent magnet may be aligned so as to exhibit multipolar anisotropy on the outer surface thereof (see Japanese Laid-Open Publication No. 1-27208, for example). In the same way, a ring-shaped permanent magnet to be provided on the outer surface of a core may also have multiple pairs of opposite magnetic poles that are arranged alternately along the outer surface thereof. When such a configuration is adopted, the resultant ring-shaped permanent magnet may be aligned so as to exhibit multipolar anisotropy on the inner surface thereof. It should be noted that such a magnet with multipolar anisotropy does not have to be aligned by using the ring-shaped permanent magnet as an aligning magnet as described above. Alternatively, any other known arrangement may also be adopted as well. For example, a number of arched magnets may be arranged in a ring shape such that multiple pairs of opposite magnetic poles alternate one after another. Also, a groove to embed a coil for creating an aligning weak magnetic field may be defined on the inner walls of a dice-shaped through hole.

In each of various preferred embodiments described above (including perpendicular alignment, radial alignment and multipolar alignment), the aligning magnetic field is applied horizontally, i.e., perpendicularly to the pressing direction (i.e., uniaxial compressing direction). Thus, the powder particles, filling the cavity, are aligned horizontally. Due to magnetic interactions, the powder particles are chained together horizontally. Powder particles, which are located on the upper surface of the loaded powder, are also chained together horizontally. As a result, the powder can be easily stored in the cavity completely without overflowing from the cavity.

Figure 9:
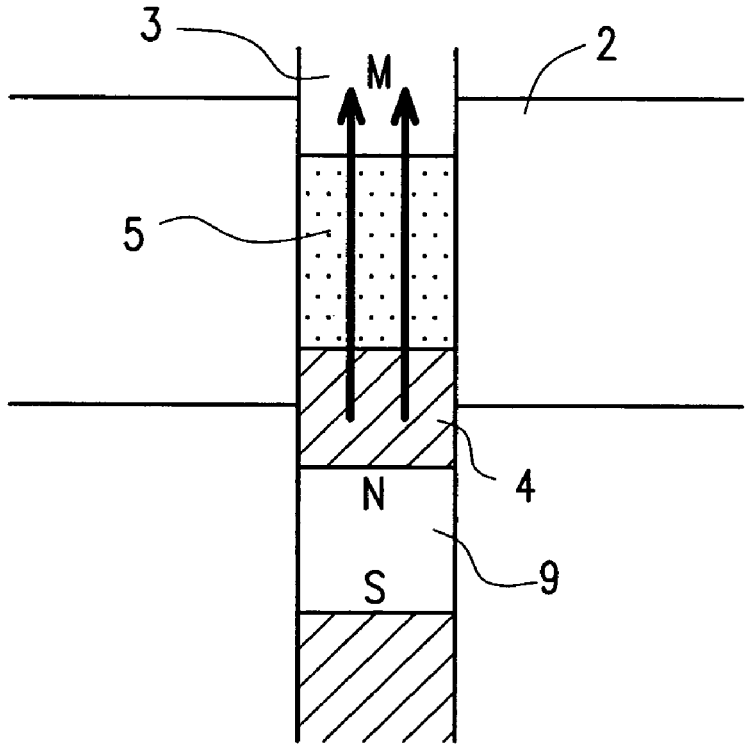
FIG. 9 illustrates a configuration for still another press machine for use in the second preferred embodiment of the present invention.

If the aligning magnetic field is applied parallel to the pressing direction, then the permanent magnet 9 may be provided under the lower punch 4 as shown in FIG. 9. In such an arrangement, the magnetization can be stronger on the lower punch 4 than on the upper punch 3. Thus, the compound 5 can be fed into the cavity smoothly.

FIG. 9 shows a state in which the compound in the cavity, defined by the upper surface of the lower punch 4 (on which the permanent magnet 9 is provided) and the inner walls of the through hole of the die 2, is being compressed by lowering the upper punch 3 after the compound has been fed into the cavity and aligned in the direction indicated by the arrow M.

In the arrangement shown in FIG. 9, the relative position of the permanent magnet 9 changes as the lower punch 4 goes up or down with respect to the die 2. However, while the compound is being fed, the lower punch 4 does not move at all, and therefore, neither the direction nor the strength of the aligning magnetic field, existing in the cavity space that is defined by the upper surface of the lower punch 4 and the inner walls of the through hole of the die 2, changes. As used herein, the "static magnetic field" refers to a magnetic field of which the direction and strength are kept substantially constant in a coordinate system that is defined by reference to the location of the cavity while the magnetic powder is being fed. Accordingly, even if the permanent magnet or the magnetic member, magnetized by the permanent magnet, moves due to the mechanical operation of the press machine, the aligning magnetic field, created in the cavity while the magnetic powder is being fed thereto, is still a "static magnetic field" as long as the direction and strength of the aligning magnetic field do not change with time but are substantially constant.

It should be noted that the center axis of the cavity of the press machine may define a tilt angle with respect to the perpendicular direction. Also, the direction of the aligning magnetic field may also define some tilt angle with respect to the horizontal direction. These arrangements are appropriately determined depending on exactly in what shape the permanent magnet should be formed.

In each of various preferred embodiments described above, a permanent magnet that has been magnetized in a predetermined direction is used. However, similar effects are also achievable even when the magnetization is carried out with a coil instead of the permanent magnet. Alternatively, not just the weak aligning magnetic field created by the member that is magnetized by the permanent magnet but also a magnetic field created by a coil may be applied as well. Even when such an additional magnetic field (which will be referred to herein as an "assisting magnetic field") is used, the aligning magnetic field in the cavity preferably also has a strength of 8 kA/m to 120 kA/m such that the resultant compact has as low a remnant magnetization as 0.005 T or less. That is to say, the aligning magnetic field strength in the cavity is preferably optimized according to the shape and sizes of the desired compact, the magnetic properties of the magnetic powder, the aligning direction, and the powder feeding rate during the magnetic powder feeding process step. To achieve complete alignment, the aligning magnetic field preferably has a high strength. However, as is clear from the following description of specific examples, once the aligning magnetic field strength reaches a predetermined strength, it is no use increasing the strength anymore, because its effects are saturated and the remnant magnetization of the compact just increases in that case. The present inventors discovered and confirmed via experiments that the magnetic field should have a strength of at least 8 kA/m to achieve the desired alignment. The upper limit thereof is preferably defined to be 120 kA/m in view of the remnant magnetization, for example. The upper limit of the aligning magnetic field is more preferably 100 kA/m and even more preferably 80 kA/m. It should be noted that the assisting magnetic field does not have to be the static magnetic field but may also be an oscillating magnetic field such as an alternating magnetic field or a pulse magnetic field. system of units.

The powder feeding rate during the powder feeding process step was held low in the first specific example but was defined as high as possible in the second specific example. As can be seen from FIG. 10, in the first specific example (as represented by the solid curve), if the magnetic field strength in the cavity was 100 Oe or more, a maximum energy product, which was as high as 90% or more of the comparative example, was achieved. In the second specific example on the other hand (as represented by the dashed curve), if the magnetic field strength in the cavity was about 400 Oe or more, a maximum energy product, which was as high as 90% or more of the comparative example, was achieved. In the second example, however, when the magnetic field strength was low, the maximum energy product was small. These results reveal that the powder feeding rate is preferably low during the powder feeding process step.

Even in the second specific example in which the powder feeding rate was high, practical magnetic properties are also achieved by increasing the strength of the aligning magnetic field (to 400 Oe (=about 32 kA/m) or more, for example). However, if the aligning magnetic field strength is increased excessively, the remnant magnetization of the resultant compact will increase so much as to cause problems similar to those observed in the prior art. To reduce the remnant magnetization to a level at which no such problems should occur magnetization of the magnets. In this manner, the magnetic field strength in the cavity was controlled at the desired value. The opening (on the upper surface) of the die cavity of the press machine (i.e., a cross-sectional shape of the cavity as taken perpendicularly to the pressing direction) was rectangular (e.g., 5 mm×20 mm) and the cavity had a depth of 40 mm.

The cavity was filled with about 10 g (gram) of the compound. A compact, formed on such a cavity, was a rectangular parallelepiped and had sizes of 5 mm (length), 20 mm (width) and 17 mm (height).

Figure 10:
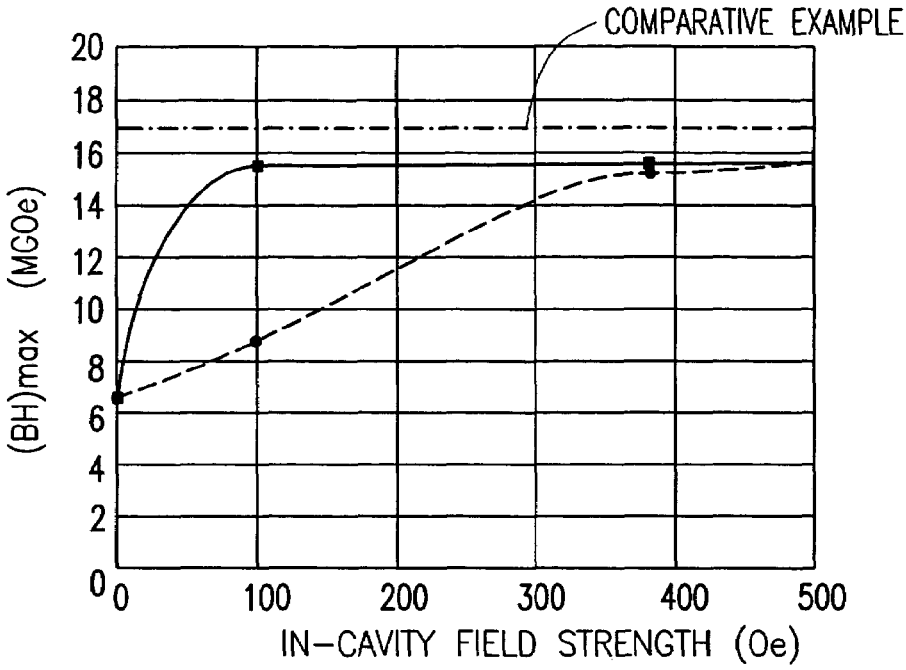
FIG. 10 is a graph showing relationships between the strength of a weak magnetic field that has been created inside of a cavity and the maximum energy product $(BH)_{max}$ of the resultant anisotropic bonded magnet.

FIG. 10 shows relationships between the strength of the weak magnetic field created in the cavity (as measured at the center of the cavity) and the maximum energy product of the resultant anisotropic bonded magnet. FIG. 10 provides data about two specific examples of the present invention, in which the powder was fed under mutually different conditions, and data about an anisotropic bonded magnet that was produced by a conventional method in which a strong magnetic field of 12 kOe was applied during the compacting process (as a comparative example).

It should be noted that the magnetic field strength as the abscissa of the graph is represented in Oe (oersted). A magnetic field strength according to the SI system of units is obtained by multiplying this value by $10^3/(4\pi)$. Since $10^3/(4\pi)$ is approximately equal to 80, 100 Oe is about 8 kA/m according to the SI

EXAMPLES

Example 1

Hereinafter, specific examples of the present invention will be described.

First, in a first specific example, an HDDR powder of an Nd—Fe—B based rare-earth alloy, including 27.5 wt % of Nd, 1.07 wt % of B, 14.7 wt % of Co, 0.2 wt % of Cu, 0.3 wt % of Ga, 0.15 wt % of Zr and Fe as the balance, was prepared. Specifically, first, a rare-earth alloy material having such a composition was thermally treated at 1,130° C. for 15 hours within an Ar atmosphere and then collapsed and sieved by a hydrogen occlusion process. Thereafter, the resultant powder was subjected to an HDDR process, thereby obtaining an HDDR powder having magnetic anisotropy. The mean particle size of the powder (as measured by laser diffraction analysis) was about 120 μm.

The HDDR powder was mixed with a binder (binder resin) of Bis-Phenol-A based epoxy resin, which was heated to 60 degrees, using a biaxial kneader, thereby making an HDDR compound. The binder was about 2.5 wt % of the overall mixture.

This HDDR compound was compressed and compacted with a press machine such as that shown in FIGS. 1 and 2. In this case, the substantial magnetic properties of the permanent magnets that were provided on the right- and left-hand sides of the die 2 were adjusted by changing the degrees of (i.e., 0.005 T or less), the aligning magnetic field strength is preferably no greater than 1,500 Oe (i.e., 120 kA/m). If the remnant magnetization should be further reduced, then the aligning magnetic field strength is more preferably 1,260 Oe (i.e., 100 kA/m) or less, even more preferably 1,000 Oe (i.e., 80 kA/m) or less and most preferably 400 Oe or less.

Example 2

A radially aligned ring-shaped anisotropic bonded magnet was produced with a press machine such as that shown in FIGS. 3 and 4. The same compound as that used in the first specific example described above was also used. The compact had an outside diameter of 25 mm, an inside diameter of 23 mm and a height of 5 mm.

Figure 11:
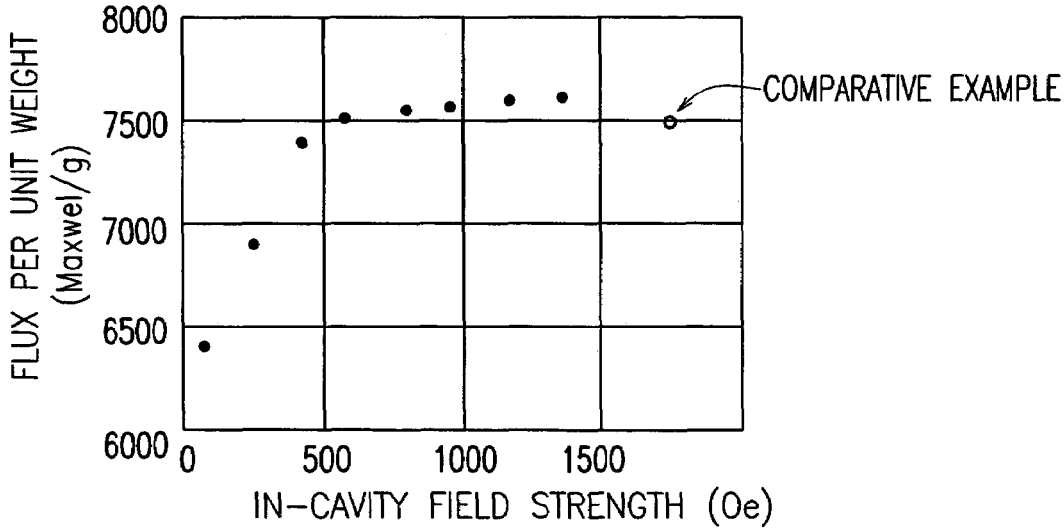
FIG. 11 is a graph showing a relationship between the strength of a weak magnetic field that has been created inside of a cavity and the flux per unit weight of the resultant anisotropic bonded magnet.

FIG. 11 shows a relationship between the strength of the weak magnetic field created in the cavity (as measured at the center of the cavity) and the flux (per unit weight) of the resultant anisotropic bonded magnet (as measured after the magnetizing process step). The flux of an anisotropic bonded magnet, which was compressed with the conventional strong magnetic field (e.g., a pulse magnetic field having a strength of 1,200 kA/m) applied thereto, is also shown as a comparative example in FIG. 11.

As can be seen from FIG. 11, the flux increased as the magnetic field strength increased, but was saturated at a field strength of about 400 Oe to about 500 Oe. To minimize the remnant magnetization and obtain a practical flux, the magnetic member is preferably magnetized such that the magnetic field strength in the cavity becomes about 400 Oe to about 600 Oe (=about 32 kA/m to about 48 kA/m).

If the aligning magnetic field strength in the cavity was higher than 1,000 Oe (i.e., 80 kA/m), the as-pressed compact (without having been subjected to any degaussing process) had a surface flux density (or remanence) of about 0.0010 tesla to about 0.0013 tesla (i.e., about 10 gauss to about 13 gauss). On the other hand, if the aligning magnetic field strength in the cavity was 1,000 Oe (i.e., 80 kA/m) or less, the remanence was less than 0.0010 tesla (i.e., 10 gauss). And if the aligning magnetic field strength in the cavity was about 500 Oe (i.e., 40 kA/m), the remanence was about 0.0005 tesla (i.e., 5 gauss).

In this specific example, the powder was fed by the method shown in FIG. 3. Accordingly, no powder particles were magnetically cross-linked together. Also, even when an aligning magnetic field with a relatively high strength was created, the powder could also be loaded quickly.

INDUSTRIAL APPLICABILITY

According to the present invention, a weak aligning magnetic field is applied as a static magnetic field to the powder being fed. Thus, the magnetic powder being loaded into the cavity can be aligned with the direction of the aligning magnetic field. Since the aligning magnetic field has a low strength, a sufficient degree of magnetic alignment is achieved and yet the magnetization, remaining in the as-pressed compact, can be reduced significantly. As a result, no degaussing process is required anymore. Consequently, while various problems resulting from the remnant magnetization are avoided, the cycle time of the pressing process can be shortened and a permanent magnet with excellent properties can be produced at a low cost.

Also, according to the present invention, the conventional coil for creating a strong aligning magnetic field is no longer needed, and the press machine can have a reduced size. In addition, the power that has been dissipated by the coil for creating an aligning magnetic field can be saved, and the cost of the pressing process can be reduced.

The invention claimed is:

1. A method for producing a permanent magnet by feeding a magnetic powder into a cavity of a press machine and compacting the magnetic powder, the method comprising the steps of:

creating a magnetic field having a strength of 8 kA/m to 120 kA/m as a static magnetic field in a space including the cavity and transporting the magnetic powder toward the inside of the cavity while aligning the magnetic powder parallel to the direction of the magnetic field; and compacting the magnetic powder inside of the cavity, thereby obtaining a compact.

2. The method of claim 1, wherein the magnetic field is created by using a magnetic member that is magnetized steadily.

3. The method of claim 1, wherein the magnetic field is also applied in the step of compacting the magnetic powder inside of the cavity.

4. The method of claim 1, wherein the magnetic field is adjusted such that the compact, which has just been pressed by the press machine, has a surface flux density of 0.005 tesla or less.

5. The method of claim 1, wherein the strength of the magnetic field is adjusted to the range of 8 kA/m to 100 kA/m inside the cavity.

6. The method of claim 5, wherein the strength of the magnetic field is adjusted to the range of 8 kA/m to 80 kA/m inside the cavity.

7. The method of claim 1, wherein after the magnetic powder has been compacted inside of the cavity, the compact is unloaded from the cavity without being subjected to any degaussing process.

8. The method of one of claims 2 to 7, wherein the magnetic member is one of members that make up a die of the press machine.

9. The method of one of claims 2 to 7, wherein at least a portion of the magnetic member is a permanent magnet.

10. The method of one of claims 1 to 7, wherein at least a portion of the magnetic powder is an HDDR powder.

11. The method of one of claims 1 to 7, wherein the press machine comprises:

a die having a though hole;

a core, which reciprocates inside of, and with respect to, the though hole; and a lower punch, which reciprocates between the inner surface of the through hole and the outer surface of the core and with respect to the die, and wherein the step of transporting the magnetic powder toward the inside of the cavity includes the steps of:

positioning a feeder box, including the magnetic powder, over the though hole of the die after the through hole has been closed up with the lower punch;

moving the core upward with respect to the die; and moving the die upward with respect to the core, thereby defining the cavity under the feeder box.

* * * * *